US006073625A

United States Patent [19]

Ball

[11] Patent Number: 6,073,625

[45] Date of Patent: Jun. 13, 2000

[54] FIREPLACE OPENING CLOSURE

[76] Inventor: Jody W. Ball, P.O. Box 692111, Houston, Tex. 77269

[21] Appl. No.: 09/186,243

[22] Filed: Nov. 5, 1998

[51] Int. Cl.[7] ..... F24B 1/192

[52] U.S. Cl. ..... 126/547; 126/545; 126/552; 49/463; 49/490.1

[58] Field of Search ..... 126/547, 544, 126/545, 552; 160/DIG. 9; 49/463, 464, 466, 465, 475.1, 490.1, 507

[56] References Cited

U.S. PATENT DOCUMENTS

| | | | |
|---|---|---|---|
| 690,599 | 1/1902 | Messer | 125/544 X |
| 1,049,653 | 1/1913 | Blackburn | 126/544 X |
| 1,968,890 | 8/1934 | Huff | 126/544 X |
| 3,797,172 | 3/1974 | Cannon | 49/463 |
| 3,888,232 | 6/1975 | Brun | 126/547 |
| 4,106,442 | 8/1978 | Miller | 126/202 |
| 4,106,476 | 8/1978 | Harsha | 126/547 |
| 5,214,880 | 6/1993 | Woodruff et al. | 49/490.1 |
| 5,301,655 | 4/1994 | Licata | 126/547 |

*Primary Examiner*—James C. Yeung

[57] ABSTRACT

A fireplace opening closure for closing the front opening of a fireplace when the fireplace is not in use. The fireplace opening closure includes a generally rectangular board with front and back faces, top and bottom edges, and a pair of side edges extending between the top and bottom edges of the board. The edges of the board are inserted into the longitudinal slots of a plurality of elongate edging members including top and bottom edging members and a pair of side edging members.

15 Claims, 2 Drawing Sheets

FIG. 1
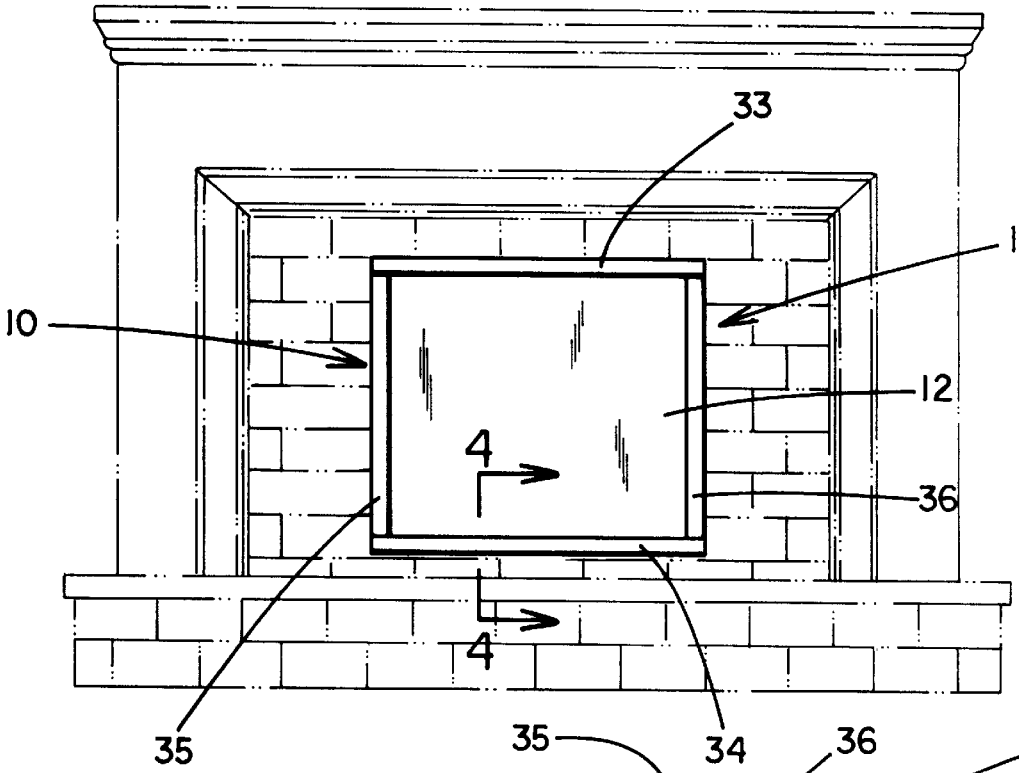
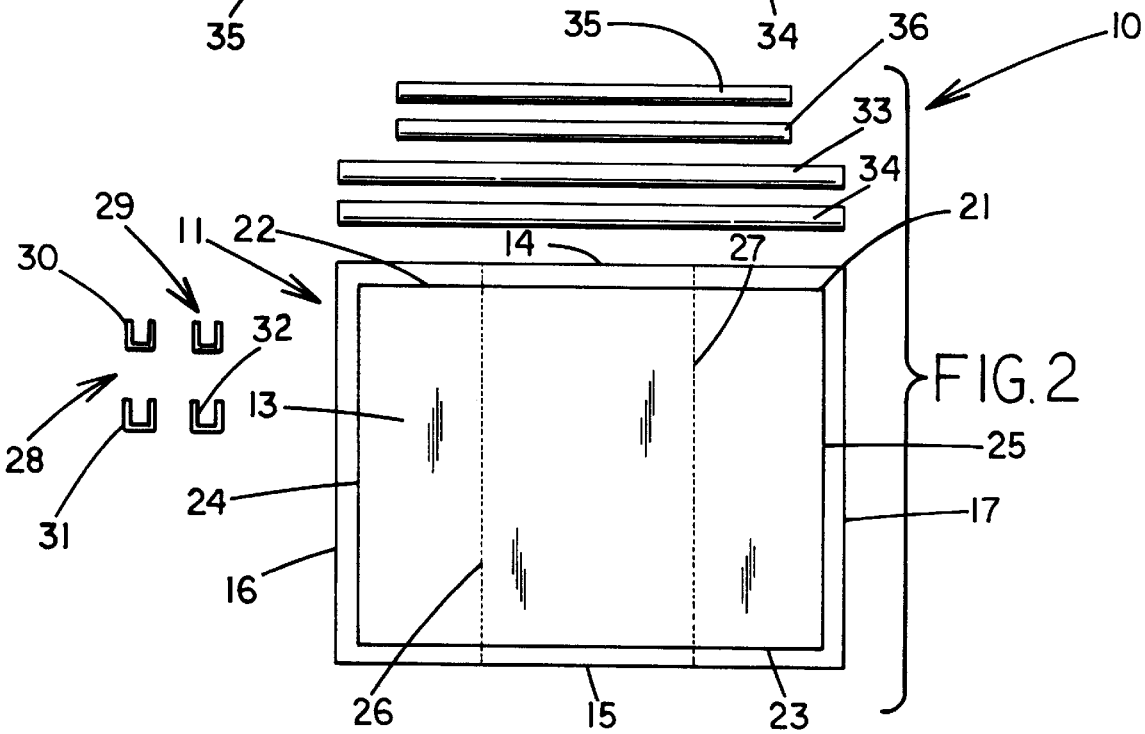
FIG. 2

FIREPLACE OPENING CLOSURE

BACKGROUND OF THE INVENTION

1. Field of the Invention

The present invention relates to closures for fireplace openings and more particularly pertains to a new fireplace opening closure for closing the front opening of a fireplace when the fireplace is not in use.

2. Description of the Prior Art

The use of closures for fireplace openings is known in the prior art. More specifically, closures for fireplace openings heretofore devised and utilized are known to consist basically of familiar, expected and obvious structural configurations, notwithstanding the myriad of designs encompassed by the crowded prior art which have been developed for the fulfillment of countless objectives and requirements.

Known prior art closures for fireplace openings include U.S. Pat. Nos. 4,108,145; 4,362,147; 3,789,825; 2,398,240; 2,077,324; and DES 345,012.

While these devices fulfill their respective, particular objectives and requirements, the aforementioned patents do not disclose a new fireplace opening closure. The inventive device includes a generally rectangular board with front and back faces, top and bottom edges, and a pair of side edges extending between the top and bottom edges of the board. The edges of the board are inserted into the longitudinal slots of a plurality of elongate edging members including top and bottom edging members and a pair of side edging members.

In these respects, the fireplace opening closure according to the present invention substantially departs from the conventional concepts and designs of the prior art, and in so doing provides an apparatus primarily developed for the purpose of closing the front opening of a fireplace when the fireplace is not in use.

SUMMARY OF THE INVENTION

In view of the foregoing disadvantages inherent in the known types of closures for fireplace openings now present in the prior art, the present invention provides a new fireplace opening closure construction wherein the same can be utilized for closing the front opening of a fireplace when the fireplace is not in use.

The general purpose of the present invention, which will be described subsequently in greater detail, is to provide a new fireplace opening closure apparatus and method which has many of the advantages of the closures for fireplace openings mentioned heretofore and many novel features that result in a new fireplace opening closure which is not anticipated, rendered obvious, suggested, or even implied by any of the prior art closures for fireplace openings, either alone or in any combination thereof.

To attain this, the present invention generally comprises a generally rectangular board with front and back faces, top and bottom edges, and a pair of side edges extending between the top and bottom edges of the board. The edges of the board are inserted into the longitudinal slots of a plurality of elongate edging members including top and bottom edging members and a pair of side edging members.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new fireplace opening closure apparatus and method which has many of the advantages of the closures for fireplace openings mentioned heretofore and many novel features that result in a new fireplace opening closure which is not anticipated, rendered obvious, suggested, or even implied by any of the prior art closures for fireplace openings, either alone or in any combination thereof.

It is another object of the present invention to provide a new fireplace opening closure which may be easily and efficiently manufactured and marketed.

It is a further object of the present invention to provide a new fireplace opening closure which is of a durable and reliable construction.

An even further object of the present invention is to provide a new fireplace opening closure which is susceptible of a low cost of manufacture with regard to both materials and labor, and which accordingly is then susceptible of low prices of sale to the consuming public, thereby making such fireplace opening closure economically available to the buying public.

Still yet another object of the present invention is to provide a new fireplace opening closure which provides in the apparatuses and methods of the prior art some of the advantages thereof, while simultaneously overcoming some of the disadvantages normally associated therewith.

Still another object of the present invention is to provide a new fireplace opening closure for closing the front opening of a fireplace when the fireplace is not in use.

Yet another object of the present invention is to provide a new fireplace opening closure which includes a generally rectangular board with front and back faces, top and bottom edges, and a pair of side edges extending between the top and bottom edges of the board. The edges of the board are inserted into the longitudinal slots of a plurality of elongate edging members including top and bottom edging members and a pair of side edging members.

Still yet another object of the present invention is to provide a new fireplace opening closure that blocks the passage of cold air from the outside of a dwelling into the dwelling through the fireplace in cold weather and blocks the passage air conditioned air from the inside of the dwelling to the outside of the dwelling through the fireplace in warm weather.

Even still another object of the present invention is to provide a new fireplace opening closure that provides a barrier to prevent children from crawling into the fireplace opening.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a schematic front side view of a new fireplace opening closure closing the front opening of a fireplace firebox according to the present invention.

FIG. 2 is a schematic plan view of the present invention in a disassembled form illustrating the separation line on the back face of the board.

DESCRIPTION OF THE PREFERRED EMBODIMENT

Figure 3:
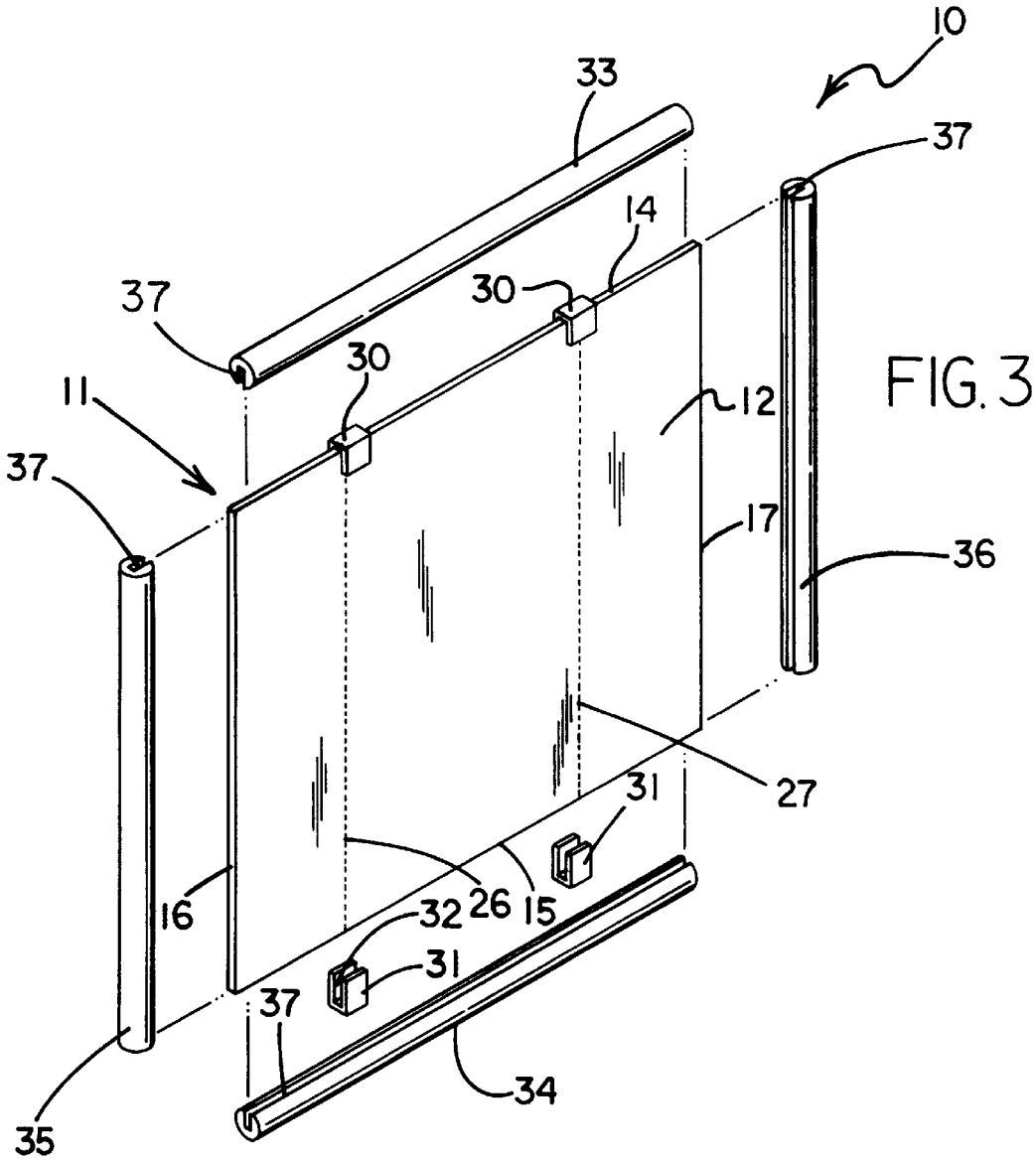
FIG. 3 is a schematic front exploded perspective view of the present invention.

With reference now to the drawings, and in particular to FIGS. 1 through 4 thereof, a new fireplace opening closure embodying the principles and concepts of the present invention and generally designated by the reference numeral 10 will be described.

As best illustrated in FIGS. 1 through 4, the fireplace opening closure 10 generally comprises a generally rectangular board 11 with front and back faces 12,13, top and bottom edges 14,15, and a pair of side edges 16,17 extending between the top and bottom edges of the board. The edges of the board are inserted into the longitudinal slots 37 of a plurality of elongate edging members including top and bottom edging members 33,34 and a pair of side edging members 35,36.

In use, as illustrated in FIG. 1, the closure 10 is designed for closing a generally rectangular front opening into a fireplace firebox 1. The front opening has a generally rectangular periphery comprising an upper side (or lintel), a lower side (or hearth), and a pair of lateral sides extending between the upper and lower sides of the front opening.

In closer detail, the closure 10 comprises a generally rectangular board 11 with substantially planar front and back faces 12,13, generally straight top and bottom edges 14,15, and a pair of generally straight side edges 16,17 extending between the top and bottom edges of the board. The front and back faces of the board preferably lie in generally parallel planes to one another. Preferably, the top and bottom edges of the board are extended generally parallel to one another. The side edges of the board are preferably extended generally parallel to one another and generally perpendicular to the top and bottom edges of the board.

The board has a thickness defined between the front and back faces of the board, a height defined between the top and bottom edges of the board and a width defined between the side edges of the board. Preferably, the thickness of the board is greater than about ½ inch to provide adequate insulation to the closure of the front opening of the firebox of the fireplace. Ideally, the thickness of the board is between about ¾ inch and about 1 inch. Preferably, the height of the board is greater than about one-half the width of the board. Ideally, the height of the board is about 19⅛ inches and the width of the board is about 36 inches.

Preferably, the board comprises front and back outer layers 18,19 and an inner core layer 20 interposed between the front and back outer layers. The front outer layer 18 is positioned at the front face 12 of the board and the back outer layer 19 is positioned at the back face 13 of the board. The front and back outer layers each comprise a heat reflecting material such as a metallic reflective insulating material. The inner core layer comprises a heat insulating material, such as a fiberglass board material or a paper board material. The front and back outer layers and the inner core layer each have a thickness defined along the thickness of the board. Preferably, the thickness of the front outer layer is about equal to the thickness of the back outer layer. Ideally, the thickness of the inner core layer is at least four times thicker than the thickness of either of the front and back outer layers for providing optimal insulation to the closure of the front opening.

The back face of the board has a generally rectangular separation line 21 thereon. The board is separable (that is: may be cut) along the separation line to reduce the size of the board to fit smaller sized front openings of a fireplace firebox. The separation line has generally parallel upper and lower segments 22,23 and generally parallel side segments 24,25 extending between the upper and lower segments of the separation line. The upper and lower segments of the separation line are extended generally perpendicular to the side segments of the separation line. The upper segment 22 is positioned adjacent the top edge 14 of the board. The lower segment 23 is positioned adjacent the bottom edge 15 of the board. One of the side segments 24 is positioned adjacent one of the side edges 16 of the board and another of the side segments 25 is positioned adjacent another of the side edges 17 of the board. The separation line is preferably substantially centered on the back face of the board. Ideally, the segments of the separation line are about equally spaced apart from the respective adjacent edge of the board.

The board has a spaced apart pair of generally parallel longitudinal folds 26,27 extending between the top and bottom edges of the board. The longitudinal folds are extended generally parallel to the side edges of the board. The longitudinal folds divide the board into three rectangular regions. In use, the longitudinal folds permit folding of the board therealong for convenient storage and transport when not closing a front opening of a fireplace firebox.

First and second pairs of generally rectangular U-shaped clamp brackets 28,29 are provided. Each pair of clamp brackets 28,29 comprises upper and lower clamp brackets 30,31. Each of the clamp brackets defines a generally rectangular U-shaped channel 32. The top edge of the board is inserted into the channels of the upper clamp brackets and the bottom edge of the board is inserted into the channels of the lower clamp brackets. The first pair of clamp brackets 28 is associated with a first of the longitudinal folds and the second pair of clamp brackets 29 is associated with a second of the longitudinal folds. Each pair of clamp brackets is positioned on the respective edge of the board at the associated longitudinal fold of the board to prevent pivoting of the board at the longitudinal folds to hold the regions of the board in a substantially planar position with the regions of the board substantially lie in common plane.

Figure 4:
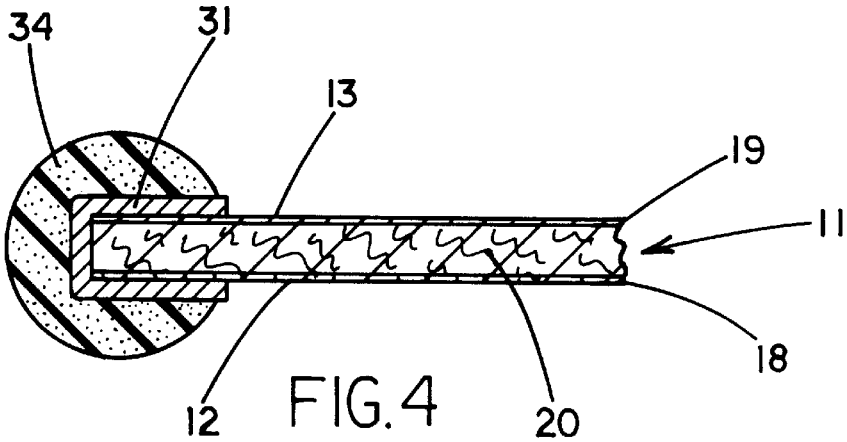
FIG. 4 is a schematic cross sectional view of the present invention taken from line 4—4 of FIG. 1.

Also provided are a plurality of elongate edging members comprising top and bottom edging members 33,34 and a pair of side edging members 35,36. Each of the edging members is generally cylindrical and has a pair of opposite ends and a longitudinal slot 37 extending between the ends of the respective edging member. As illustrated in FIG. 4, each of the edging members has a generally circular transverse cross section has a diameter. Preferably, the diameters of the edging members are about equal to one another. The diameter of each of the edging members is also preferably at least two times greater than the thickness of the of the board. Ideally, the diameter of each of the edging members is about three times greater than the thickness of the board member to help insure a tight fit in the front opening of the fireplace firebox.

The longitudinal slot of each of the edging members has a generally rectangular U-shaped transverse cross section designed for receiving an edge of the board. The top edge of the board is inserted into the longitudinal slot of the top edging member 33. The bottom edge of the board is inserted into the longitudinal slot of the bottom edging member 34. One of the side edges of the board is inserted into the longitudinal slot of one of the side edging members 35. The other of the side edges of the board is inserted into the longitudinal slot of the other of the side edging members 36. Preferably, the top and bottom edging members extend between the side edges of the board. The side edging members preferably extend between the top and bottom edging members such that the ends of the side edging members abut the top and bottom edging members.

Each of the edging members preferably comprises a resiliently compressible material. Ideally, each of the edging members comprises a resiliently compressible foamed material.

In use, the board is designed for positioning in a generally rectangular front opening of a fireplace firebox to substantially close the front opening such that the board generally lies in a vertical plane. The edging members is designed for abutting against corresponding portions of an outer periphery of the front opening of the fireplace firebox to further insure a tight closure of the front opening. The edging members is designed for is compressed between the board and the outer periphery of the front opening of the fireplace firebox to hold the board in a fixed position with respect to the front opening of the fireplace firebox.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A closure for a front opening into a fireplace firebox, said closure comprising:

a board having front and back faces, top and bottom edges, and a pair of side edges extending between said top and bottom edges of said board, said board comprising front and back outer layers and an inner core layer interposed between said front and back outer layers, said front outer layer being positioned at said front face of said board, said back outer layer being positioned at said back face of said board, said front and back outer layers each comprise a heat reflecting material, wherein said inner core layer comprises a heat insulating material;

a plurality of edging members comprising top and bottom edging members and a pair of side edging members;

each of said edging members having a pair of opposite ends and a longitudinal slot extending between said ends of the respective edging member; and said top edge of said board being inserted into said longitudinal slot of said top edging member, said bottom edge of said board being inserted into said longitudinal slot of said bottom edging member, one of said side edges of said board being inserted into said longitudinal slot of one of said side edging members, the other of said side edges of said board being inserted into said longitudinal slot of the other of said side edging members.

2. The closure of claim 1, wherein said board has a thickness defined between said front and back faces of said board, a height defined between said top and bottom edges of said board and a width defined between said side edges of said board, and wherein said height of said board is greater than about one-half said width of said board.

3. The closure of claim 2, wherein said thickness of said board is greater than about ½ inch.

4. The closure of claim 1, wherein said front and back outer layers and said inner core layer each have a thickness defined along said thickness of said board, wherein said thickness of said inner core layer is at least four times thicker than the thickness of either of said front and back outer layers.

5. The closure of claim 4, wherein said thickness of said front outer layer is about equal to said thickness of said back outer layer.

6. The closure of claim 1, wherein said back face of said board has a generally rectangular separation line thereon, said board being separable along said separation line.

7. The closure of claim 6, wherein said separation line has a generally parallel upper and lower segments and generally parallel side segments extending between said upper and lower segments of said separation line, said upper and lower segments of said separation line being extended generally perpendicular to said side segments of said separation line, wherein said upper segment is positioned adjacent said top edge of said board, said lower segment is positioned adjacent said bottom edge of said board, one of said side segments is positioned adjacent one of said side edges of said board, and another of said side segments is positioned adjacent another of said side edges of said board.

8. The closure of claim 7, wherein said separation line is substantially centered on said back face of said board.

9. The closure of claim 8, wherein said segments of said separation line are about equally spaced apart from the respective adjacent edge of said board.

10. The closure of claim 1, wherein said board has a spaced apart pair of generally parallel longitudinal folds extending between said top and bottom edges of said board, said longitudinal folds being extended generally parallel to said side edges of said board.

11. The closure of claim 10, further comprising first and second pairs of generally U-shaped clamp brackets, each pair of clamp brackets comprising upper and lower clamp brackets, each of said clamp brackets defining a channel, said top edge of said board being inserted into said channels of said upper clamp brackets, said bottom edge of said board being inserted into said channels of said lower clamp brackets, said first pair of clamp brackets being associated with a first of said longitudinal folds, said second pair of clamp brackets being associated with a second of said longitudinal folds, each pair of clamp brackets being positioned on the respective edge of said board at the associated longitudinal fold of said board to prevent pivoting of said board at said longitudinal folds to hold said board in a substantially planar position.

12. A closure for a generally rectangular front opening into a fireplace firebox, said closure comprising:

a generally rectangular board having substantially planar front and back faces, generally straight top and bottom edges, and a pair of generally straight side edges extending between said top and bottom edges of said board;

said front and back faces of said board lying in generally parallel planes to one another, said top and bottom edges of said board being extended generally parallel to one another, said side edges of said board being extended generally parallel to one another and generally perpendicular to said top and bottom edges of said board;

said board having a thickness defined between said front and back faces of said board, a height defined between said top and bottom edges of said board and a width defined between said side edges of said board;

wherein said thickness of said board is greater than about ½ inch;

wherein said height of said board is greater than about one-half said width of said board;

wherein said board comprises front and back outer layers and an inner core layer interposed between said front and back outer layers, said front outer layer being positioned at said front face of said board, said back outer layer being positioned at said back face of said board;

said front and back outer layers each comprising a heat reflecting material such, wherein said inner core layer comprises a heat insulating material;

said front and back outer layers and said inner core layer each having a thickness defined along said thickness of said board, wherein said thickness of said front outer layer is about equal to said thickness of said back outer layer, wherein said thickness of said inner core layer is at least four times thicker than the thickness of either of said front and back outer layers;

said back face of said board having a generally rectangular separation line thereon, said board being separable along said separation line;

said separation line having a generally parallel upper and lower segments and generally parallel side segments extending between said upper and lower segments of said separation line, said upper and lower segments of said separation line being extended generally perpendicular to said side segments of said separation line;

said upper segment being positioned adjacent said top edge of said board, said lower segment being positioned adjacent said bottom edge of said board, one of said side segments being positioned adjacent one of said side edges of said board, and another of said side segments being positioned adjacent another of said side edges of said board;

said separation line being substantially centered on said back face of said board, wherein said segments of said separation line are about equally spaced apart from the respective adjacent edge of said board;

said board having a spaced apart pair of generally parallel longitudinal folds extending between said top and bottom edges of said board, said longitudinal folds being extended generally parallel to said side edges of said board;

first and second pairs of generally U-shaped clamp brackets, each pair of clamp brackets comprising upper and lower clamp brackets;

each of said clamp brackets defining a channel, said top edge of said board being inserted into said channels of said upper clamp brackets, said bottom edge of said board being inserted into said channels of said lower clamp brackets;

said first pair of clamp brackets being associated with a first of said longitudinal folds, said second pair of clamp brackets being associated with a second of said longitudinal folds;

each pair of clamp brackets being positioned on the respective edge of said board at the associated longitudinal fold of said board to prevent pivoting of said board at said longitudinal folds to hold said board in a substantially planar position;

a plurality of elongate edging members comprising top and bottom edging members and a pair of side edging members;

each of said edging members being generally cylindrical and having a pair of opposite ends and a longitudinal slot extending between said ends of the respective edging member;

each of said edging members having a generally circular transverse cross section having a diameter, wherein said diameters of said edging members are about equal to one another, wherein said diameter of each of said edging members is at least two times greater than said thickness of said of said board;

said top edge of said board being inserted into said longitudinal slot of said top edging member, said bottom edge of said board being inserted into said longitudinal slot of said bottom edging member, one of said side edges of said board being inserted into said longitudinal slot of one of said side edging members, the other of said side edges of said board being inserted into said longitudinal slot of the other of said side edging members;

said top and bottom edging members extending between said side edges of said board, said side edging members extending between said top and bottom edging members such that said ends of said side edging members abut said top and bottom edging members;

each of said edging members comprising a resiliently compressible material, each of said edging members comprising a resiliently compressible foamed material; and wherein said board is adapted for positioning in a generally rectangular front opening of a fireplace firebox to substantially close the front opening, said edging members being adapted for abutting against corresponding portions of an outer periphery of the front opening of the fireplace firebox, said edging members being adapted for being compressed between said board and the outer periphery of the front opening of the fireplace firebox to hold said board in a fixed position with respect to the front opening of the fireplace firebox.

13. In combination:

a generally rectangular board having substantially planar front and back faces, generally straight top and bottom edges, and a pair of generally straight side edges extending between said top and bottom edges of said board;

said front and back faces of said board lying in generally parallel planes to one another, said top and bottom edges of said board being extended generally parallel to one another, said side edges of said board being extended generally parallel to one another and generally perpendicular to said top and bottom edges of said board;

said board having a thickness defined between said front and back faces of said board, a height defined between said top and bottom edges of said board and a width defined between said side edges of said board;

wherein said thickness of said board is greater than about ½ inch;

wherein said height of said board is greater than about one-half said width of said board;

wherein said board comprises front and back outer layers and an inner core layer interposed between said front and back outer layers, said front outer layer being positioned at said front face of said board, said back outer layer being positioned at said back face of said board;

said front and back outer layers each comprising a heat reflecting material such, wherein said inner core layer comprises a heat insulating material;

said front and back outer layers and said inner core layer each having a thickness defined along said thickness of said board, wherein said thickness of said front outer layer is about equal to said thickness of said back outer layer, wherein said thickness of said inner core layer is at least four times thicker than the thickness of either of said front and back outer layers;

said back face of said board having a generally rectangular separation line thereon, said board being separable along said separation line;

said separation line having a generally parallel upper and lower segments and generally parallel side segments extending between said upper and lower segments of said separation line, said upper and lower segments of said separation line being extended generally perpendicular to said side segments of said separation line;

said upper segment being positioned adjacent said top edge of said board, said lower segment being positioned adjacent said bottom edge of said board, one of said side segments being positioned adjacent one of said side edges of said board, and another of said side segments being positioned adjacent another of said side edges of said board;

said separation line being substantially centered on said back face of said board, wherein said segments of said separation line are about equally spaced apart from the respective adjacent edge of said board;

said board having a spaced apart pair of generally parallel longitudinal folds extending between said top and bottom edges of said board, said longitudinal folds being extended generally parallel to said side edges of said board;

first and second pairs of generally U-shaped clamp brackets, each pair of clamp brackets comprising upper and lower clamp brackets;

each of said clamp brackets defining a channel, said top edge of said board being inserted into said channels of said upper clamp brackets, said bottom edge of said board being inserted into said channels of said lower clamp brackets;

said first pair of clamp brackets being associated with a first of said longitudinal folds, said second pair of clamp brackets being associated with a second of said longitudinal folds;

each pair of clamp brackets being positioned on the respective edge of said board at the associated longitudinal fold of said board to prevent pivoting of said board at said longitudinal folds to hold said board in a substantially planar position;

a plurality of elongate edging members comprising top and bottom edging members and a pair of side edging members;

each of said edging members being generally cylindrical and having a pair of opposite ends and a longitudinal slot extending between said ends of the respective edging member;

each of said edging members having a generally circular transverse cross section having a diameter, wherein said diameters of said edging members are about equal to one another, wherein said diameter of each of said edging members is at least two times greater than said thickness of said of said board;

said top edge of said board being inserted into said longitudinal slot of said top edging member, said bottom edge of said board being inserted into said longitudinal slot of said bottom edging member, one of said side edges of said board being inserted into said longitudinal slot of one of said side edging members, the other of said side edges of said board being inserted into said longitudinal slot of the other of said side edging members;

said top and bottom edging members extending between said side edges of said board, said side edging members extending between said top and bottom edging members such that said ends of said side edging members abut said top and bottom edging members;

each of said edging members comprising a resiliently compressible material, each of said edging members comprising a resiliently compressible foamed material; and said board being positioned in a generally rectangular front opening of a fireplace firebox to substantially close the front opening; and said edging members abutting against an outer periphery of the front opening of the fireplace firebox, said edging members being compressed between said board and the outer periphery of the front opening of the fireplace firebox to hold said board in a fixed position with respect to the front opening of the fireplace firebox.

14. A closure for a front opening into a fireplace firebox, said closure comprising:

a board having front and back faces, top and bottom edges, and a pair of side edges extending between said top and bottom edges of said board, said board having a spaced apart pair of generally parallel longitudinal folds extending between said top and bottom edges of said board, said longitudinal folds being extended generally parallel to said side edges of said board;

a plurality of edging members comprising top and bottom edging members and a pair of side edging members;

each of said edging members having a pair of opposite ends and a longitudinal slot extending between said ends of the respective edging member;

said top edge of said board being inserted into said longitudinal slot of said top edging member, said bottom edge of said board being inserted into said longitudinal slot of said bottom edging member, one of said side edges of said board being inserted into said longitudinal slot of one of said side edging members, the other of said side edges of said board being inserted into said longitudinal slot of the other of said side edging members; and said back face of said board having a generally rectangular separation line thereon, said board being separable along said separation line, wherein said separation line having a generally parallel upper and lower segments and generally parallel side segments extending between said upper and lower segments of said separation line, said upper and lower segments of said separation line being extended generally perpendicular to said side segments of said separation line, wherein said upper segment being positioned adjacent said top edge of said board, said lower segment being positioned adjacent said bottom edge of said board, one of said side segments being positioned adjacent one of said side edges of said board, and another of said side segments being positioned adjacent another of said side edges of said board, wherein said separation line is substantially centered on said back face of said board.

15. A closure for a front opening into a fireplace firebox, said closure comprising:

a board having front and back faces, top and bottom edges, and a pair of side edges extending between said top and bottom edges of said board;

a plurality of edging members comprising top and bottom edging members and a pair of side edging members;

each of said edging members having a pair of opposite ends and a longitudinal slot extending between said ends of the respective edging member;

said top edge of said board being inserted into said longitudinal slot of said top edging member, said bottom edge of said board being inserted into said longitudinal slot of said bottom edging member, one of said side edges of said board being inserted into said longitudinal slot of one of said side edging members, the other of said side edges of said board being inserted into said longitudinal slot of the other of said side edging members; and first and second pairs of generally U-shaped clamp brackets, each pair of clamp brackets comprising upper and lower clamp brackets, each of said clamp brackets defining a channel, said top edge of said board being inserted into said channels of said upper clamp brackets, said bottom edge of said board being inserted into said channels of said lower clamp brackets, said first pair of clamp brackets being associated with a first of said longitudinal folds, said second pair of clamp brackets being associated with a second of said longitudinal folds, each pair of clamp brackets being positioned on the respective edge of said board at the associated longitudinal fold of said board to prevent pivoting of said board at said longitudinal folds to hold said board in a substantially planar position.

* * * * *